US006802295B2

(12) United States Patent
Bedwell et al.

(10) Patent No.: US 6,802,295 B2
(45) Date of Patent: Oct. 12, 2004

(54) AIR INTAKE SHUTOFF DEVICE WITH CONNECTING LINKAGE

(75) Inventors: Matthew Ross Bedwell, Lafayette, IN (US); Jeffrey Yeager, Lafayette, IN (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/324,055

(22) Filed: Dec. 20, 2002

(65) Prior Publication Data

US 2004/0118374 A1 Jun. 24, 2004

(51) Int. Cl.[7] ..... F02B 77/00

(52) U.S. Cl. ..... 123/198 D; 251/63.4; 251/336

(58) Field of Search ..... 123/198 D, 184.21, 123/336, 308; 251/63.4; 60/611

(56) References Cited

U.S. PATENT DOCUMENTS 1,926,019 A * 9/1933 Aseltine ..... 123/184.54
2,854,026 A * 9/1958 Ball ..... 137/595
4,499,733 A 2/1985 Farr et al. ..... 60/611
4,501,238 A 2/1985 Odum ..... 123/198 D
5,003,943 A 4/1991 Lafferty, Sr. ..... 123/198 D
5,778,851 A * 7/1998 Schellhase et al. ..... 123/337
5,873,343 A 2/1999 Denton ..... 123/198 D
6,032,921 A 3/2000 Krepela ..... 251/63.4
6,273,053 B1 8/2001 Krepela et al. ..... 123/198 D
6,276,328 B1 8/2001 Denton et al. ..... 123/198 D

* cited by examiner

*Primary Examiner*—Tony M. Argenbright
*Assistant Examiner*—Katrina B. Harris
(74) *Attorney, Agent, or Firm*—Finnegan, Henderson, Farabow, Garrett & Dunner

(57) ABSTRACT

An air intake shutoff device is disclosed for an engine. The device includes at least two air shutoff valve assemblies. Each of these assemblies has a gate for controlling air flow into the engine. A linkage couples together the gates of each of the air shutoff valve assemblies such that closing of one gate of the at least two air shutoff valve assemblies effectuates closing of all other gates of the at least two air shutoff valve assemblies.

26 Claims, 6 Drawing Sheets

AIR INTAKE SHUTOFF DEVICE WITH CONNECTING LINKAGE

TECHNICAL FIELD

This invention relates generally to an air intake shutoff device and, more particularly, to an air intake shutoff device for an engine having multiple air shutoff valve assemblies.

BACKGROUND

Internal combustion engines may be operated in a variety of environments. Some environments associated with, for example, marine propulsion power, marine auxiliary power, petroleum production, locomotive applications, mining, industrial applications, electrical power generation, and chemical plants may include atmospheres with high levels of volatile hydrocarbons. In such applications, these volatile hydrocarbons may be drawn into air intakes of the engine and supplied to the engine cylinders. These hydrocarbons may act as a secondary fuel source and can combust along with the regularly supplied fuel. As a result, the engine may operate uncontrollably to a point where the engine rotates at a speed in excess of its design limits. Catastrophic engine failure may occur if the secondary fuel source is not eliminated.

To prevent catastrophic failure, internal combustion engines may include an air shutoff device that blocks all airflow to the engine. Such an air shutoff device may be configured to include multiple air shutoff valve assemblies, each having a gate that blocks the airflow into a respective air intake passage of the engine. These air intake passages may be associated with turbocharger units, for example. The air shutoff valve assemblies may be manually or automatically actuated using, for example, electrical or hydraulic actuators. In the event that unwanted, combustible hydrocarbons are drawn into an engine and an over-speed condition results, the air shutoff device may be activated to perform an emergency engine stop (i.e., an "e-stop" event) in which each air intake pathway into the engine is blocked by a respective air shutoff valve assembly. By shutting off the air supply to the engine, the shutoff device starves the engine of oxygen and the secondary fuel source and terminates combustion in the cylinders. In this manner, the air shutoff device may prevent damage to the engine caused by uncontrolled over-speed.

After an e-stop event, each air shutoff valve assembly of the air shutoff device must be reopened prior to re-starting the engine. Operation of the engine with only some of the air shutoff valve assemblies in the open position can result in engine damage. In existing air shutoff devices, the responsibility to ensure that all of the air shutoff valve assemblies of the air shutoff device were fully opened belonged to the engine operator. Because the air shutoff valve assemblies of existing air shutoff devices were not linked together mechanically, the engine operator had to manually open each air shutoff valve assembly after an e-stop event. This arrangement takes time and increases the likelihood of engine damage caused by an air shutoff valve assembly inadvertently left closed prior to re-starting the engine.

The present invention is directed to overcoming one or more of the problems or disadvantages existing in these former systems.

SUMMARY OF THE INVENTION

A first aspect of the invention includes an air intake shutoff device for an engine. The device includes at least two air shutoff valve assemblies. Each of these assemblies has a gate for controlling air flow into the engine. A linkage couples together the gates of each of the air shutoff valve assemblies such that closing of one gate of the at least two air shutoff valve assemblies effectuates closing of all other gates of the at least two air shutoff valve assemblies.

A second aspect of the invention includes a linkage for an air shutoff device of an engine. The linkage includes a shaft having a first end and a second end and defining a longitudinal axis. A first universal joint has a near end and a distal end and is attached to the shaft such that the near end of the first universal joint connects to the first end of the shaft. A second universal joint has a near end and a distal end and is attached to the shaft such that the near end of the second universal joint connects to the second end of the shaft.

A third aspect of the invention includes an engine having at least two turbochargers. An air shutoff valve assembly is attached to each of the at least two turbochargers, and each air shutoff valve assembly includes a gate for controlling the flow of air to the engine. A linkage couples together the gate of each air shutoff valve assembly such that closing of the gate of one air shutoff valve assembly effectuates closing of all other gates of the air shutoff valve assemblies.

DETAILED DESCRIPTION

Figure 1:
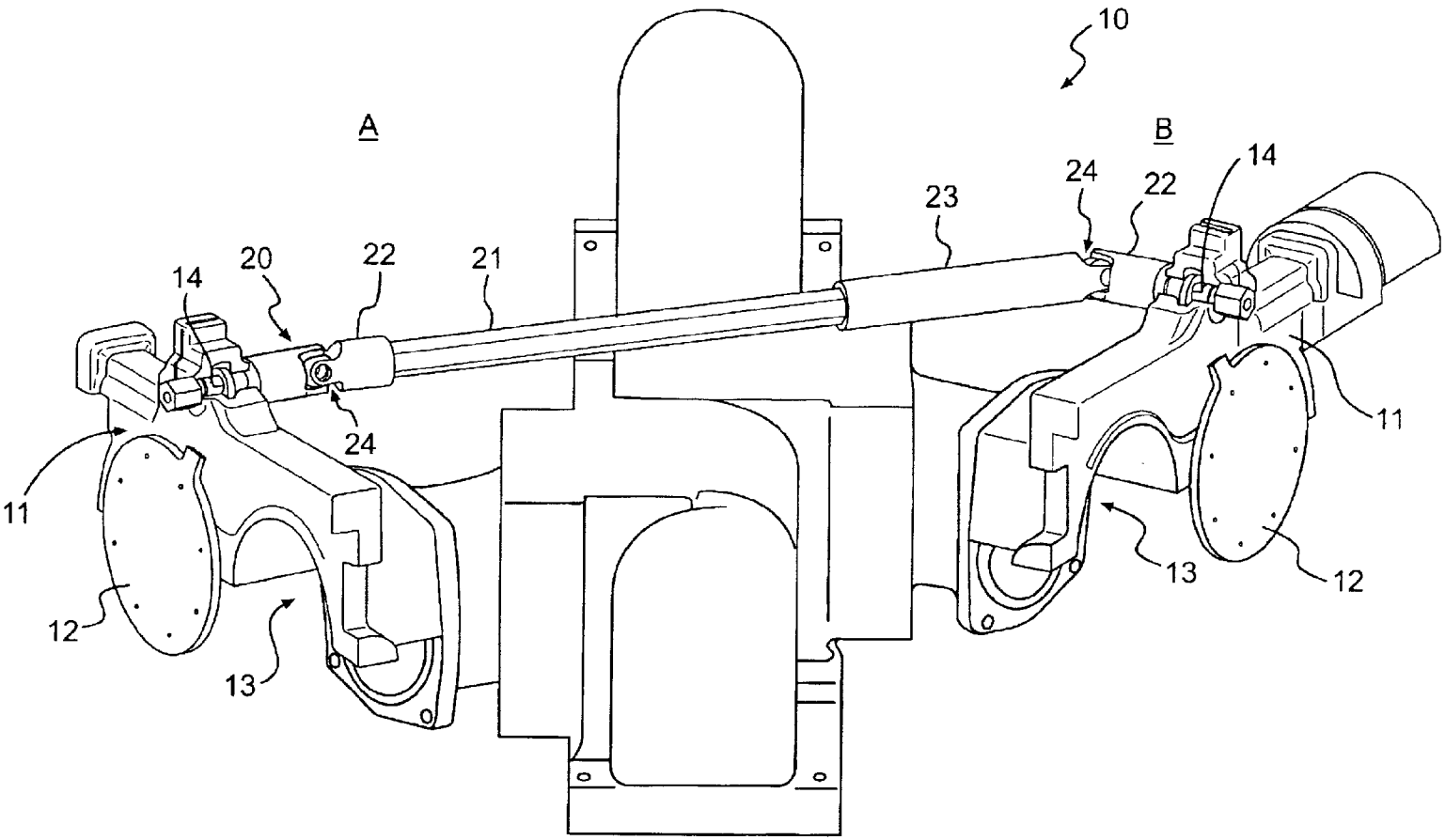
FIG. 1 is a diagrammatic partial cut-away representation of an air shutoff device in an open position in accordance with an exemplary embodiment of the invention.
Figure 2:
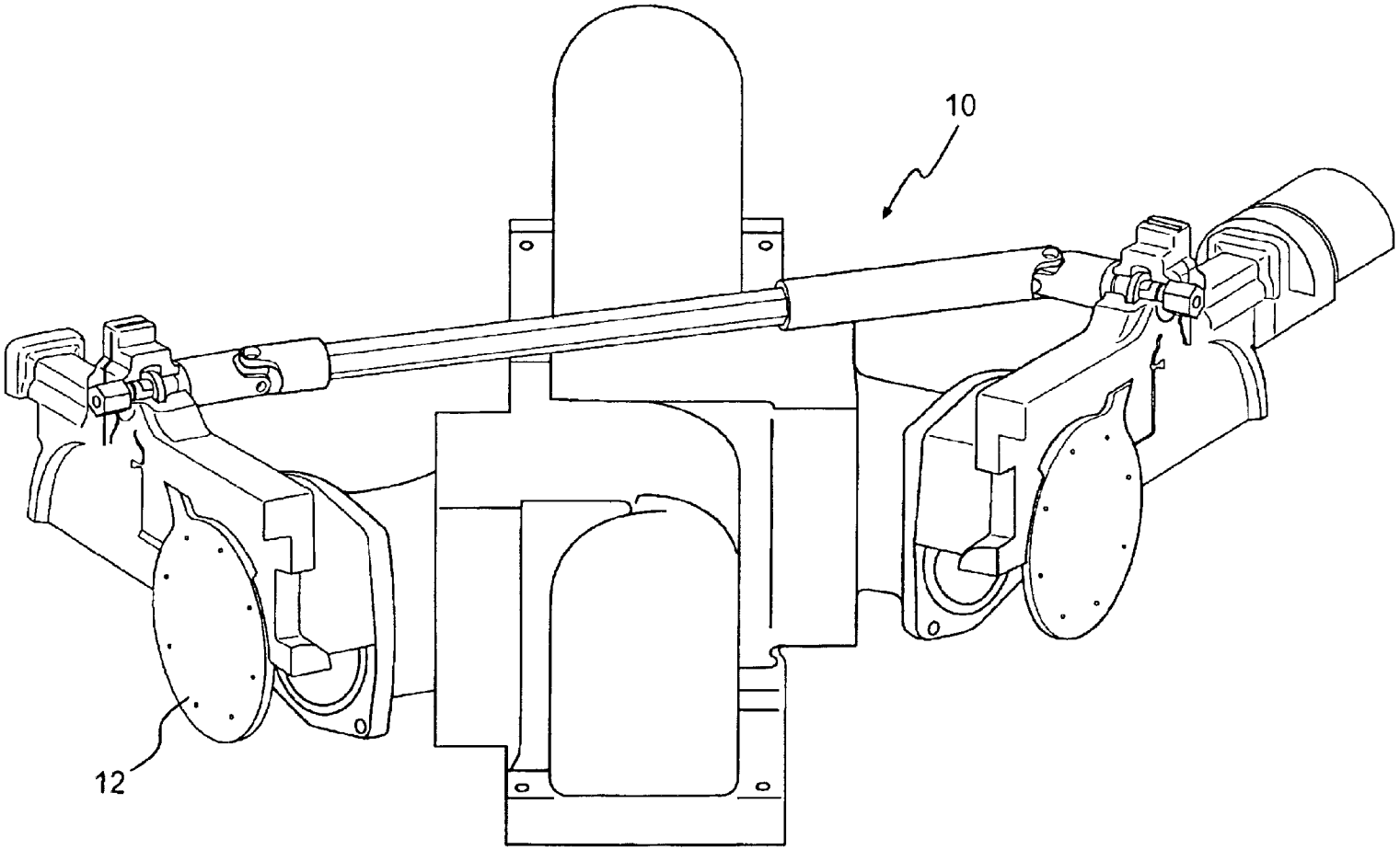
FIG. 2 is a diagrammatic partial cut-away representation of an air shutoff device in a closed position in accordance with an exemplary embodiment of the invention.

FIG. 1 represents an air intake shutoff device 10 for an engine according to an exemplary embodiment of the invention. Air intake shutoff device 10 includes at least two air shutoff valve assemblies 11. Each of the air shutoff valve assemblies 11 includes a gate 12 that controls air flow through the air shutoff valve assembly. Each gate 12 may be mounted within air shutoff valve assembly 11 with, for example, a mounting pin 14. Each gate 12 may rotate about mounting pin 14 between a fully open position, as shown in FIG. 1, and a fully closed position in which the gate covers a respective air intake 13, as shown in FIG. 2. In the fully closed position, gates 12 substantially block all air flow into the engine through air intakes 13. Without a source of oxygen, combustion in the engine ceases, and the engine shuts down.

Figure 3:
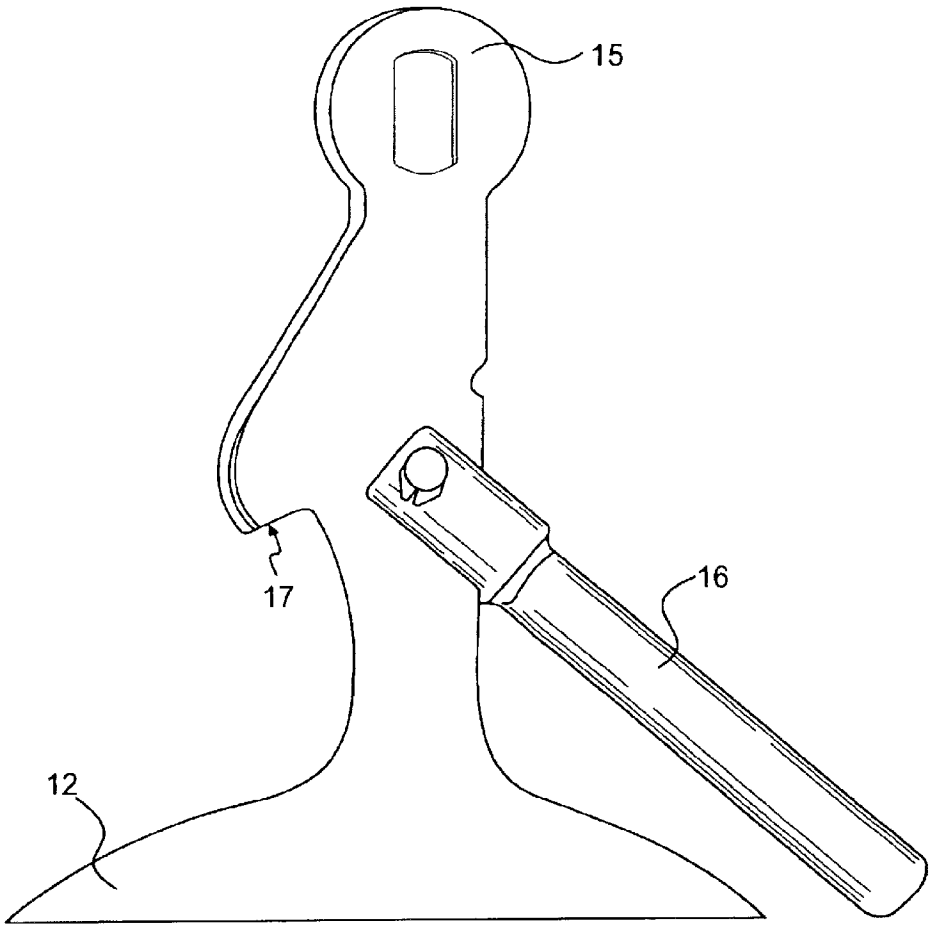
FIG. 3 is a diagrammatic sideview of the latching portion of an air shutoff valve gate in accordance with an exemplary embodiment of the invention.

As shown in FIG. 3, each gate 12 may include a gate pivot 15 configured to mate with mounting pin 14. In an exemplary embodiment, gate pivot 15 may include a through hole with flat wall segments. Mounting pin 14 extends through the hole on gate pivot 15 and may include flat sections that engage with the corresponding flat wall segments on gate pivot 15. This configuration ensures that gate 12 and mounting pin 14 rotate together. Gate pivot 15 and mounting pin 14, however, may include other configurations without departing from the scope of the invention.

Air intake shutoff device 10 also includes a linkage 20 that couples together the gates 12 of air shutoff valve assemblies 11. By coupling each of gates 12 together, linkage 20 enables the gates to move together. As a result, if an e-stop event occurs that closes a gate, then all other gates coupled to the closing gate through linkage 20 will also close. Similarly, if one gate is brought into an open position, then all other gates coupled to the opening gate through linkage 20 are also brought into an open position. In this way, linkage 20 helps to ensure that all gates 12 of air shutoff valve assemblies 11 operate together.

Linkage 20 may include several different configurations depending on the requirements of a particular application. The number of gates 12 to be coupled together, the relative angle of orientation between the gates, the distance between the gates, and the type of connection to be made to each of the gates may all affect the design and configuration of linkage 20. In certain embodiments, linkage 20 may include at least one shaft 21. Connection elements 22 may be included on shaft 21 for attaching respective gates 12 to shaft 21.

While FIG. 1 illustrates two air shutoff valve assemblies 11 and two gates 12 to be coupled together through linkage 20, linkage 20 may be used with any number of air shutoff valve assemblies 11 and gates 12. For example, linkage 20 may be specifically configured to couple together the gates of two or more air shutoff devices in engines that may include, for example, two or more turbocharger units operating in parallel.

Figure 5:
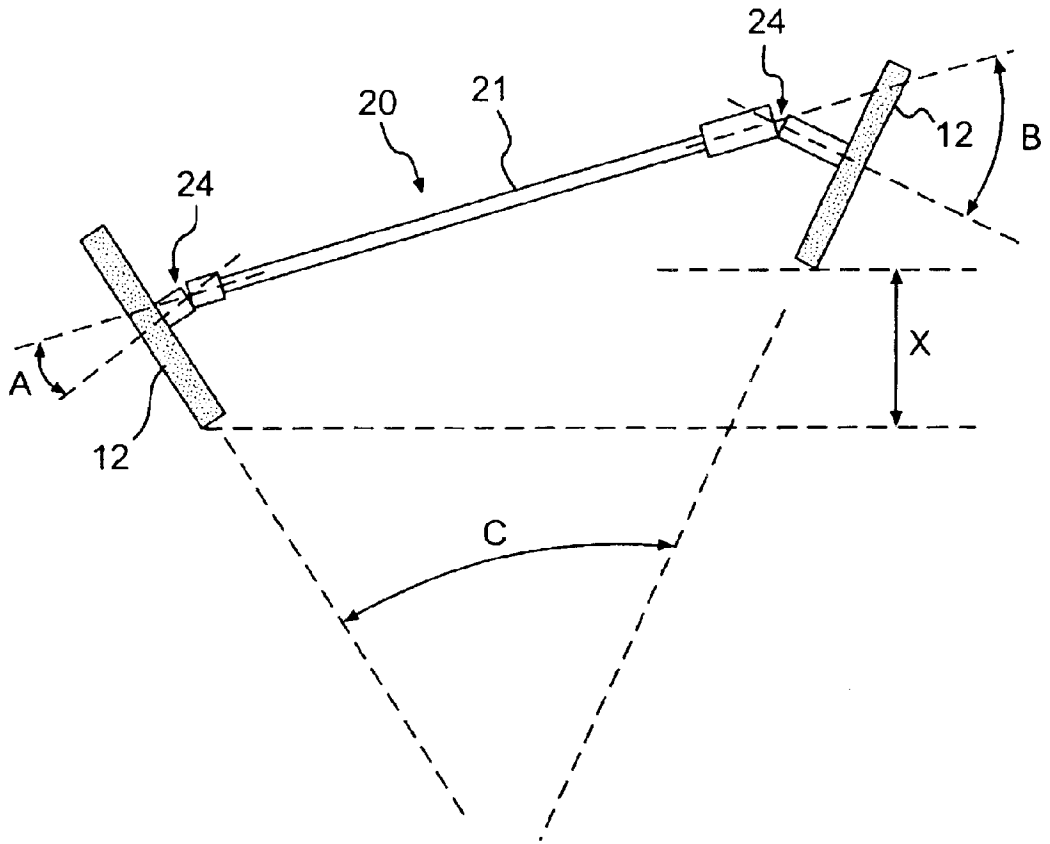
FIG. 5 is a diagrammatic representation of an exemplary embodiment of the present invention including various orientation parameters.

The relative angle of orientation between the gates may also affect the configuration of linkage 20. As shown in FIG. 5, linkage 20 may couple together gates 12 that are offset from one another by a distance X and/or include a relative angle of orientation C between them. In such an arrangement, connection elements 22 may include universal joints 24 attached to the ends of shaft 21 that compensate for the offset and relative angle of orientation existing between corresponding gates 12.

If a relative angle of orientation and/or an offset exists between the gates 12 of corresponding air shutoff valve assemblies 11, and if universal joints 24 are included on linkage 20, the rotational position of the universal joints with respect to shaft 21 may affect the operation of air shutoff valve assemblies 11. For example, each universal joint will have an associated joint angle (e.g., angles A or B, as shown in FIG. 5), which is determined by the distance between the gates to be coupled, the relative angle of orientation between those gates, and/or the offset distance between the gates to be coupled. These joint angles determine the rotational characteristics of respective universal joints 24, which directly affects the rotational characteristics of the corresponding gates. For example, if a universal joint attached to a first gate has a joint angle A that is different from the joint angle B of a universal joint attached to a second gate, then the first and second gates may not have the same rotation speed at all times during their respective cycles of opening and closing.

In engines with multiple air shutoff valve assemblies 11, it may be desirable to have the gates of all the air shutoff valve assemblies reach their respective fully open and fully closed positions substantially simultaneously (e.g., with respect to a pair of coupled gates, there exists a lag of less than 0.1 degrees, and more particularly, less than 0.05 degrees between corresponding gates upon reaching their respective fully open or fully closed positions). This minimizes or eliminates potential damage to the engine that may be caused by operating the engine under a condition where one or more air shutoff valve assembly is not fully open or by attempting to shut down an engine where one or more air shutoff valve assembly is not fully closed. Operating the gates in this manner may also minimize or eliminate possible damage to the gates of the air shutoff valve assemblies resulting from dynamic loading of gates 12 and linkage 20 that may occur when one gate closes and at least one other gate remains partially open.

Figure 6B:
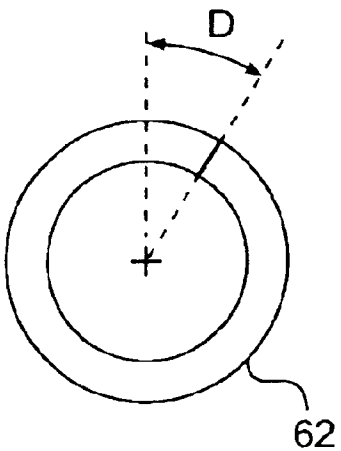
FIG. 6B represents the rotational orientation of another connecting element with respect to the shaft in an exemplary embodiment of the present invention.
Figure 6A:
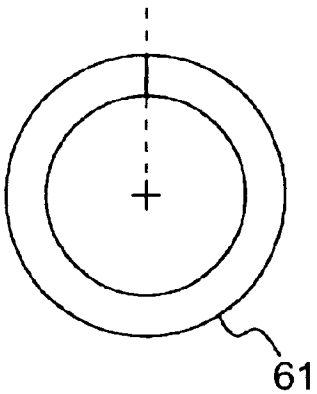
FIG. 6A represents the rotational orientation of a connecting element with respect to the shaft in an exemplary embodiment of the present invention.

The rotational position of universal joints 24 with respect to shaft 21 may be adjusted to help ensure that the gates of the air shutoff valve assemblies reach their respective fully open and fully closed positions substantially simultaneously. Specifically, using the rotational position of a first universal joint on shaft 21 as a reference, the rotational position of a second universal joint may be offset from the position of the first universal joint to account for any differences in rotational characteristics between the first and second universal joints. FIG. 6A provides an end view representation of a first universal joint 61 positioned on one end of shaft 21. FIG. 6B provides an end view representation of a second universal joint 62 positioned on another end of shaft 21. As shown, universal joint 62 has been rotationally oriented on shaft 21 by an angle D with respect to the rotational position of universal joint 61. Angle D may be determined experimentally by rotating shaft 21 and adjusting angle D until respective gates reach their respective fully open and fully closed positions substantially simultaneously. Alternatively, angle D may be calculated using three-dimensional modeling software or other appropriate techniques.

Figure 4:
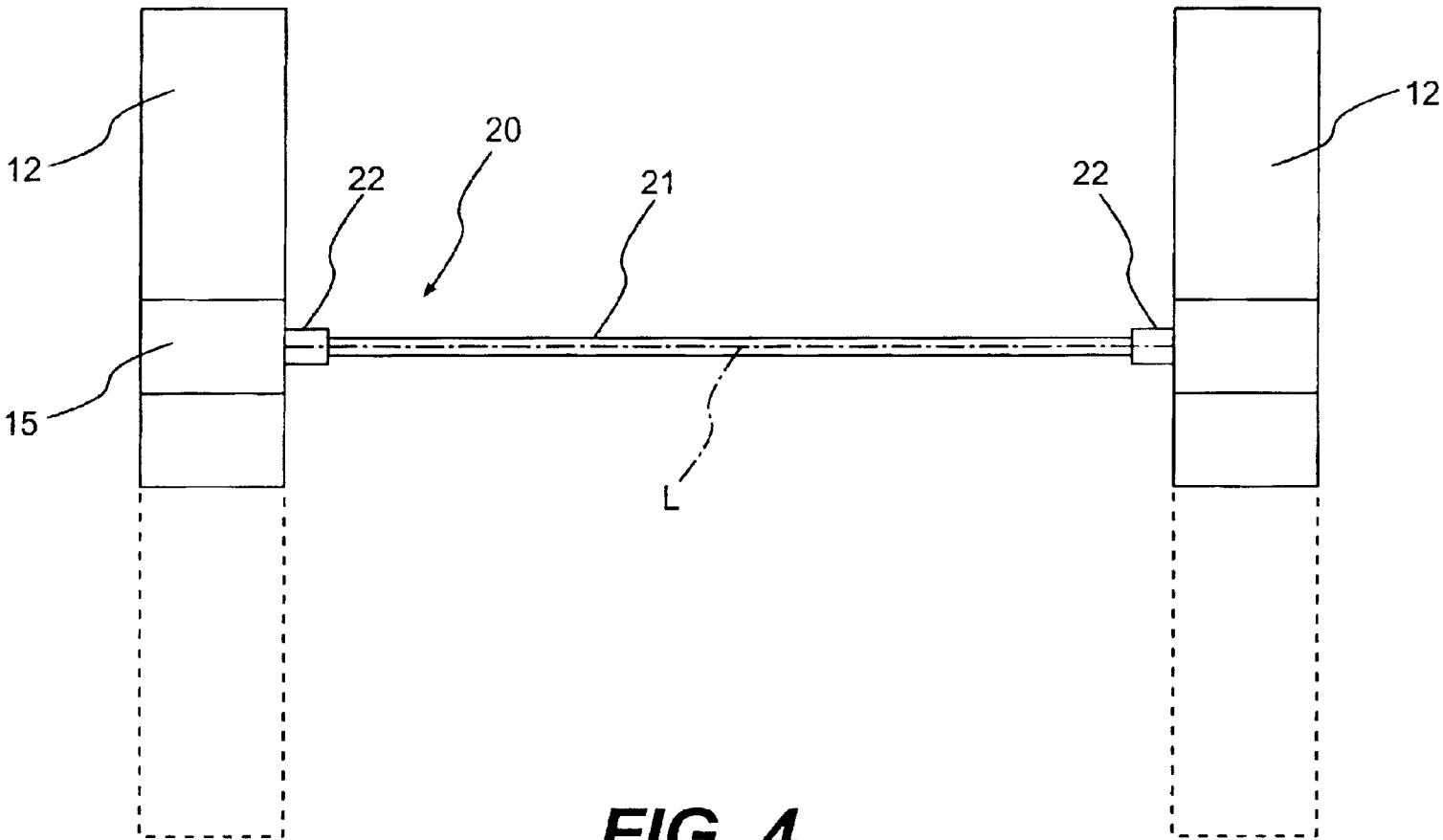
FIG. 4 is a diagrammatic top-view of an air shutoff device in accordance with an exemplary embodiment of the invention.

In a basic configuration of the invention, as illustrated in the top view of FIG. 4, linkage 20 may not include universal joints. In this exemplary embodiment, linkage 20 may couple together two gates arranged to face one another such that the gates rotate in parallel planes (e.g., where one gate is effectively a mirror image of another). As shown in FIG. 4, gates are in an open position. The dotted lines in FIG. 4 represent the position of gates 12 in a closed position. In such an embodiment, linkage 20 may be configured to include a single shaft 21 having a connection element 22 attached to each end. In this illustrative example, each gate may be attached to a respective connection element 22 such that a longitudinal axis L defined by shaft 21 intersects the rotational planes of gates 12 at substantially right angles. In this example, the rotation of one gate would be directly translated to the other gate by linkage 20, such that the two gates rotate substantially in unison.

In an exemplary embodiment of the invention, the length of linkage 20 may be variable. At least one of connection elements 22 may freely slide along shaft 21 in a direction parallel to the longitudinal axis defined by shaft 21. For example, one or more of connection elements 22 may include a sliding member 23 that slides along shaft 21. The length of sliding member 23 may be varied according to the amount of sliding travel that is desired for a particular application. Allowing connection elements 22 to move in this manner enables a particular linkage 20 to be used over a wide range of distances between gates.

Additionally, this sliding ability of connection elements 22 may accommodate any thermal growth of shaft 21.

Shaft 21 may be configured with a cross section that prevents rotation of connection elements 22 about shaft 21. For example, shaft 21 may include a hexagonal cross section, a square cross section, or any other appropriate cross section to aid in fixing the rotational position of each of connection elements 22.

Connection elements 22 may be attached to gates 12 through any of a variety of means. In one exemplary embodiment, gates 12 may rotate about a mounting pin 14 including a hexagonal shaft. Connection elements 22 may be configured to include female hex inserts that mate directly with the hexagonal shaft of mounting pins 14. Once attached together, the connection elements 22 may be fixed to mounting pins 14 with any of a variety of fasteners, by welding, or by any other suitable method of attachment.

Linkage 20 enables air shutoff valve assemblies 11 to be operated in a master-slave arrangement. Thus, rather than having two or more independently actuated air shutoff valve assemblies (i.e., where each air shutoff valve assembly includes its own actuator for closing the gate), the present invention may include only one actuated air shutoff valve assembly. The actuated air shutoff valve assembly may serve as a master, and all other air shutoff valve assemblies coupled together by linkage 20 may serve in a slave capacity. For example, a spring-biased gate of the master air shutoff valve assembly may be held in a fully open position by a gate-holding device, such as a firing pin. The gate may be biased by a spring connected to an arm 16, which is attached to gate 12 as shown in FIG. 3. Further, a firing pin or other device may seat against a latch 17, as shown in FIG. 3. In an e-stop event, for example, an actuator (e.g., mechanical, electrical, or hydraulic) may displace the firing pin and allow the spring-biased gate to move to a closed position under the force of the associated spring. Linkage 20 translates the gate motion of the master air shutoff valve assembly to the slave air shutoff valve assemblies.

Industrial Applicability

The disclosed linkage may be used in connection with engines having multiple air shutoff valve assemblies. Such engines may include, for example, diesel engines with or without turbocharger units. Linkage 20 mechanically couples the air flow controlling elements (e.g., gates) of each of the multiple air shutoff valve assemblies. Through this coupling, the linkage helps to ensure that the multiple air shutoff valve assemblies are maintained together in a fully open position or a fully closed position. Ensuring that the air shutoff valve assemblies operate together in this way may minimize or eliminate possible damage to the engine and/or the air shutoff valve assemblies.

When an engine is shut down using the air shutoff valve assemblies to stop the flow of air to the engine (i.e., an e-stop event), linkage 20 may ensure that all gates 12 of the respective air shutoff valve assemblies reach a fully closed position substantially simultaneously. Linkage 20 also aids in opening the shutoff valve assemblies 11 after an e-stop event.

Linkage 20 reduces the possibility of engine damage by moving all of the air shutoff valve assemblies together. For example, upon opening any one of the air shutoff valve assemblies, either manually or automatically, linkage 20 would translate this operation to all other air shutoff valve assemblies and return them to their respective fully open position as well. In this way, linkage 20 prevents inadvertently leaving one or more of the air shutoff valves closed, which could damage the engine upon attempting to restart the engine.

It will be apparent to those skilled in the art that various modifications and variations can be made in the described linkage without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. An air intake shutoff device for an engine comprising:

at least two air shutoff valve assemblies, each including a gate for controlling air flow into the engine; and a linkage that couples together each gate of the at least two air shutoff valve assemblies such that closing of one gate of the at least two air shutoff valve assemblies effectuates closing of all other gates of the at least two air shutoff valve assemblies, wherein one of the at least two air shutoff valve assemblies is operated as a master assembly and all others of the at least two air shutoff valve assemblies are operated as slave assemblies.

2. The air intake shutoff device of claim 1, wherein, upon closing, all gates of the at least two air shutoff valve assemblies reach a fully closed position substantially simultaneously.

3. The air intake shutoff device of claim 1, wherein, through operation of the linkage, opening of one gate of the at least two air shutoff valve assemblies effectuates opening of all other gates of the at least two air shutoff valve assemblies.

4. The air intake shutoff device of claim 1, wherein the linkage includes:

a shaft having a first end and a second end and defining a longitudinal axis;

a first connection element attached to the first end of the shaft, and a second connection element attached to the second end of the shaft.

5. The air intake shutoff device of claim 4, wherein at least one of the first and second connection elements makes sliding contact with the shaft and slides in a direction along the longitudinal axis of the shaft.

6. The air intake shutoff device of claim 4, wherein both the first connection element and the second connection element include a universal joint.

7. The air intake shutoff device of claim 6, wherein the universal joints of both the first and second connection elements are rotationally oriented with respect to the shaft such that the gates of all air shutoff valve assemblies reach a fully closed position substantially simultaneously.

8. A linkage for an air shutoff device of an engine, comprising:

a shaft having a first end and a second end and defining a longitudinal axis;

a first universal joint having a near end and a distal end, the near end being attached to the first end of the shaft; and a second universal joint having a near end and a distal end, the near end being attached to the second end of the shaft, wherein the near end of at least one of the first universal joint and second universal joint makes sliding contact with the shaft and slides in a direction along the longitudinal axis of the shaft during operation of the air shutoff device.

9. The linkage of claim 8, wherein the distal end of the first universal joint connects to a gate of a first air shutoff valve assembly of the air shutoff device, and the distal end of the second universal joint connects to a gate of a second air shutoff valve assembly of the air shutoff device.

10. The linkage of claim 9, wherein both the first and second universal joints are rotationally oriented with respect to the shaft such that the gate of the first air shutoff valve assembly and the gate of the second air shutoff valve assembly reach a fully closed position substantially simultaneously.

11. An engine comprising:

at least two air intakes;

an air shutoff valve assembly attached to each of the at least two air intakes, each air shutoff valve assembly including a gate for controlling the flow of air to the engine; and a linkage that couples together the gate of each air shutoff valve assembly such that closing of the gate of one air shutoff valve assembly effectuates closing of all other gates of the air shutoff valve assemblies, wherein one of the air shutoff valve assemblies is operated as a master assembly and all others of the air shutoff valve assemblies are operated as slave assemblies.

12. The engine of claim 11, wherein, upon closing, the gates of all the air shutoff valve assemblies reach a fully closed position substantially simultaneously.

13. The engine of claim 11, wherein, through operation of the linkage, opening the gate of one air shutoff valve assembly effectuates opening of all other gates of the air shutoff valve assemblies.

14. The engine of claim 11, wherein the linkage includes:

a shaft having a first end and a second end and defining a longitudinal axis;

a first connection element attached to the first end of the shaft; and a second connection element attached to the second end of the shaft.

15. The engine of claim 14, wherein at least one of the first and second connection elements makes sliding contact with the shaft and slides in a direction along the longitudinal axis of the shaft.

16. The engine of claim 14, wherein both the first connection element and the second connection element include a universal joint, the universal joints of both the first and second connection elements being rotationally oriented with respect to the shaft such that the gates of respective air shutoff valve assemblies reach a fully closed position substantially simultaneously.

17. An air intake shutoff device for an engine having two turbochargers operating in parallel, comprising:

a first air shutoff valve assembly attached to one of the two turbochargers, the first air shutoff valve assembly including a first gate for controlling air flow through the first shutoff valve assembly;

a second air shutoff valve assembly attached to the other of the two turbochargers, the second air shutoff valve assembly including a second gate for controlling air flow through the second shutoff valve assembly;

a linking member attached to both the first gate and the second gate, the linking member including:

a shaft having a first end and a second end, a first universal joint connected between the first gate and the first end of the shaft, and a second universal joint connected between the second gate and the second end of the shaft; and wherein the linking member mechanically couples the first gate and the second gate together such that when the first gate is in a fully open position, the second gate is also in a fully open position, and when the first gate is in a fully closed position, the second gate is also in a fully closed position.

18. An air intake shutoff device for an engine comprising:

at least two air shutoff valve assemblies, each including a gate, wherein the gates are configured to substantially block all air flow into the engine; and a linkage that couples together each gate of the at least two air shutoff valve assemblies such that closing of one gate of the at least two air shutoff valve assemblies effectuates closing of all other gates of the at least two air shutoff valve assemblies, wherein the linkage includes:

a shaft having a first end and a second end and defining a longitudinal axis;

a first connection element attached to the first end of the shaft, and a second connection element attached to the second end of the shaft, wherein at least one of the first and second connection elements makes sliding contact with the shaft and slides in a direction along the longitudinal axis of the shaft.

19. The air intake shutoff device of claim 18, wherein, upon closing, all gates of the at least two air shutoff valve assemblies reach a fully closed position substantially simultaneously.

20. The air intake shutoff device of claim 18, wherein, through operation of the linkage, opening of one gate of the at least two air shutoff valve assemblies effectuates opening of all other gates of the at least two air shutoff valve assemblies.

21. An air intake shutoff device for an engine comprising:

at least two air shutoff valve assemblies, each including a gate, wherein the gates are configured to substantially block all air flow into the engine; and a linkage that couples together each gate of the at least two air shutoff valve assemblies such that closing of one gate of the at least two air shutoff valve assemblies effectuates closing of all other gates of the at least two air shutoff valve assemblies, wherein the linkage includes:

a shaft having a first end and a second end and defining a longitudinal axis;

a first connection element attached to the first end of the shaft, and a second connection element attached to the second end of the shaft, wherein both the first connection element and the second connection element include a universal joint.

22. The air intake shutoff device of claim 21, wherein the universal joints of both the first and second connection elements are rotationally oriented with respect to the shaft such that the gates of all air shutoff valve assemblies reach a fully closed position substantially simultaneously.

23. An engine comprising:

at least two air intakes;

an air shutoff valve assembly attached to each of the at least two air intakes, each air shutoff valve assembly including a gate, wherein the gates are configured to substantially block all flow of air to the engine; and a linkage that couples together the gate of each air shutoff valve assembly such that closing of the gate of one air shutoff valve assembly effectuates closing of all other gates of the air shutoff valve assemblies, wherein the linkage includes:

a shaft having a first end and a second end and defining a longitudinal axis;

a first connection element attached to the first end of the shaft; and a second connection element attached to the second end of the shaft, wherein at least one of the first and second connection elements makes sliding contact with the shaft and slides in a direction along the longitudinal axis of the shaft.

24. The engine of claim 23, wherein, upon closing, the gates of all the air shutoff valve assemblies reach a fully closed position substantially simultaneously.

25. The engine of claim 23, wherein, through operation of the linkage, opening the gate of one air shutoff valve assembly effectuates opening of all other gates of the air shutoff valve assemblies.

26. An engine comprising:

at least two air intakes;

an air shutoff valve assembly attached to each of the at least two air intakes, each air shutoff valve assembly including a gate, wherein the gates are configured to substantially block all flow of air to the engine; and a linkage that couples together the gate of each air shutoff valve assembly such that closing of the gate of one air shutoff valve assembly effectuates closing of all other gates of the air shutoff valve assemblies, wherein the linkage includes:

a shaft having a first end and a second end and defining a longitudinal axis;

a first connection element attached to the first end of the shaft; and a second connection element attached to the second end of the shaft, wherein both the first connection element and the second connection element include a universal joint, the universal joints of both the first and second connection elements being rotationally oriented with respect to the shaft such that the gates of respective air shutoff valve assemblies reach a fully closed position substantially simultaneously.

* * * * *